United States Patent [19]

Carter, Sr. et al.

[11] 4,050,357

[45] Sept. 27, 1977

[54] STEAM ADMISSION VALVE AND VARIABLE CLEARANCE VOLUME STEAM CYLINDER

[76] Inventors: J. Warne Carter, Sr.; J. Warne Carter, Jr., both of 2206 Weeks Park Lane, Wichita Falls, Tex. 76354

[21] Appl. No.: 639,585

[22] Filed: Dec. 10, 1975

Related U.S. Application Data

[63] Continuation of Ser. No. 483,046, June 25, 1974, abandoned, which is a continuation of Ser. No. 321,375, Jan. 5, 1973, abandoned.

[51] Int. Cl.[2] ..... F15B 13/04; F01L 1/20

[52] U.S. Cl. ..... 91/410; 91/245

[58] Field of Search ..... 91/395, 394, 325, 341, 91/342, 410, 272, 273, 265, 268; 251/321

[56] References Cited

U.S. PATENT DOCUMENTS

| | | | |
|---|---|---|---|
| 648,820 | 5/1900 | Wetzel | 91/341 R |
| 734,533 | 7/1903 | Fouts | 91/325 |
| 1,203,018 | 10/1916 | Larson | 91/325 |
| 3,361,036 | 1/1968 | Harvey et al. | 91/401 |
| 3,465,647 | 9/1969 | Carson | 91/395 |

*Primary Examiner*—Paul E. Maslousky
*Attorney, Agent, or Firm*—Shapiro and Shapiro

[57] ABSTRACT

A high-speed steam admission poppet valve structure in a steam engine employs a low-inertia valve element spring-biased into seated position in a valve seat in the end wall of a cylinder and employs a valve lifter member fixed to the face of the associated piston for cyclically unseating the valve element, the lifter member and the valve element having cooperable engageable surfaces of conforming configuration which are maintained in engagement in both the unseating and seating of the valve element for maintaining the sealing surface of the valve element both parallel to and centered in relation to the valve seat in the seating of the valve element.

The clearance volume of the cylinder may be adjusted manually or automatically to regulate the power output and efficiency of the engine.

20 Claims, 14 Drawing Figures

STEAM ADMISSION VALVE AND VARIABLE CLEARANCE VOLUME STEAM CYLINDER

This is a continuation of application Ser. No. 483,046, filed June 25, 1974, which is a continuation of Ser. No. 321,375, filed Jan. 5, 1973 now abandoned.

This invention relates to steam engines, and more particularly to improvements in proper valves for high sppeed steam engines and for arrangements for varying the clearance volume in the associated cylinder in accordance with desired power and efficiency requirements.

SUMMARY OF THE INVENTION

The main object of the invention is to provide a novel and improved popper valve structure for a high speed stream engine with a substantial deree of cutoff and wherein there is high valve impact velocity, the improved structure being relatively simple, employing a minimum number of parts, and reducing the amount of stress on the parts during operation.

A further objects of the invention is to provide a steam engine poppet valve structure wherein the components have low mass so as to reduce the inertia effects, wherein the lifter element and the valve element have matching or conforming configurations for optimum sealing action and uniform deceleration force distribution, wherein efficient centering action is provided to by preventing the valve element from floating away from the associated lifter element, and wherein impact stresses are reduced by employing a resilient valve seat and making the valve lifter elements somewhat resilient.

A still further object of the invention is to provide an improved high speed poppet-type valve structure wherein stress on the parts is minimized and wherein means are provided for varying the clearance volume of the associated cylinder so as to regulate the power and efficiency of the engine, the clearance regulating means being either of a manually operated type wherein the clearance volume may be adjusted independently of the pressure or speed of the associated engine or of an automatic type.

A still further object of the invention is to provide an improved means for automatically varying the clearance volume in the cylinders of a high speed steam engine operating at high power output.

A still further object of the invention is to provide an improved high speed steam engine structure of the type employing poppet valves for steam admission wherein a substantial degree of cutoff is employed, the structure being arranged to minimize stresses on the valve components and being further provided with means to control the clearance in the engine cylinders in a manner such that the size of the engine may be relatively small but still has high power overload capabilities.

A valve structure in accordance with the invention in a steam engine having a cylinder containing a reciprocable piston and having a steam admission chamber communicating with the cylinder through a circular valve port in the end wall of the cylinder comprises an annular valve seat surrounding the valve port; a valve element in the chamber having an annular sealing surface for engaging the valve seat, and spring means biasing the valve member into seated position to close the valve port. A lifter member fixed to the face of the piston has an abutment surface for cyclically engaging a cooperable surface on the valve element to unseat the valve element against the force of said spring means to open the valve port, the spring means having sufficient strength to maintain the abutment surface and the cooperable surface in engagement in both the seating and unseating of the valve element. To ensure that the sealing surface of the valve element is both parallel to and centered in relation to the valve seat in the seating of the valve element, the abutment surface and the cooperable surface comprise conforming surfaces of revolution which are sustantially concentric with the valve seat and the sealing surface, and may comprise conical or spherical surfaces, for example. To reduce impact stresses, annular recesses may be formed in the end wall of the cylinder to provide resiliency in the region of the valve set, and the lifter member may comprise a resilient body.

When the valve seat and the sealing surface of the valve element comprise planar surfaces, a plurality of valve elements and associated lifter members may be employed in a single cylinder to control a corresponding plurality of valve ports formed in the end wall of the cylinder.

The clearance volume of the cylinder may be adjusted manually or automatically to regulate the horsepower output and efficiency of the engine.

Further objects and advantages of the invention will become apparent from the following detailed description of the invention.

DETAILED DESCRIPTION OF THE PREFERRED EMBODIMENTS

Figure 1:
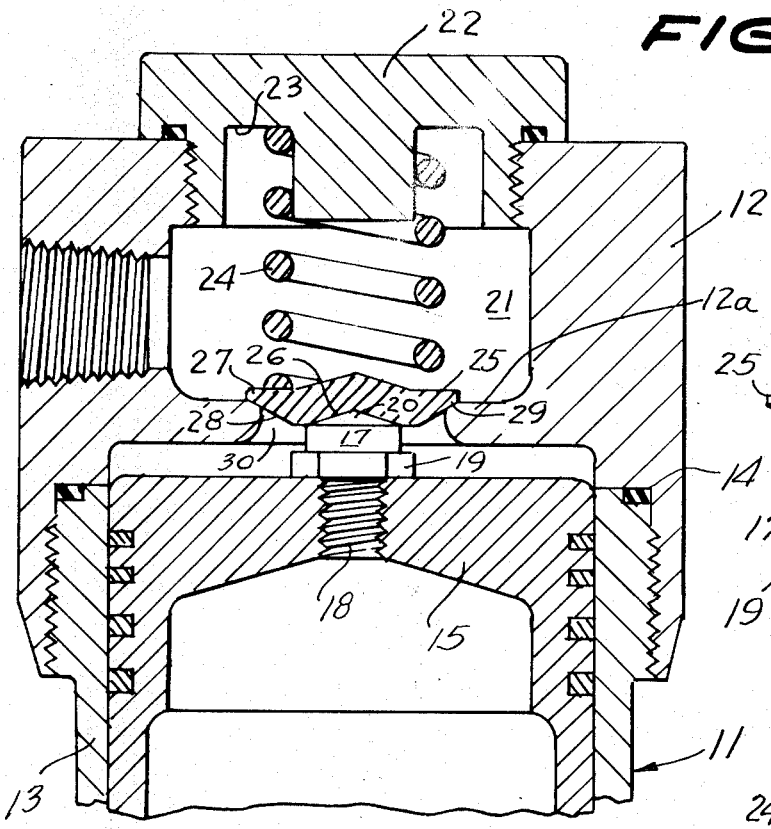
FIG. 1 is a vertical cross-sectional view taken through the upper portion of a cylinder of an improved steam engine according to the present invention showing one form of improved poppet valve structure which may be employed in accordance with the present invention, wherein the valve element is shown in seated position.
Figure 3:
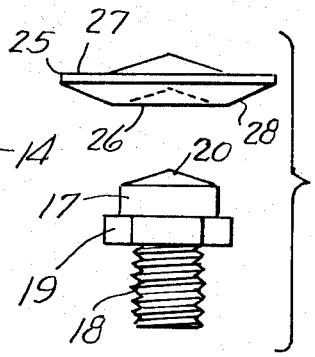
FIG. 3 is a side elevational view showing the valve disc and lifter elements of the valve structure of FIGS. 1 and 2.

A prime purpose of the present invention is to provide practical and improved poppet valve structure in a high speed steam engine wherein the piston speed is relatively high, for example, of the order of twenty-five hundred feet per minute, and with substantial cutoff, for example, of the order of three percent. Under these conditions, with previously employed valve structure, the impact at which the piston strikes the valve would be very great and the stresses generated under these conditions would be dangerously excessive. Generally speaking, the impact stresses are functions of the piston speed, the degree of cutoff and the mass of the associated valves. Previously employed structures have employed round valve balls, and such valve balls have considerable mass and substantial inertia relative to the amount of valve opening generated with a given lift. As the ball size increases, the inertia likewise increases, the increase being at a much faster rate than the valve opening. Thus, with the round ball valve, the impact velocity must be kept low because of the inertia effects of such a valve. Impact stresses increase approximately with the square of the impact velocity. Thus, when the impact velocity is doubled, the impact stresses will increase approximately four times.

The present invention aims to provide a valve system designed to operate at piston speeds of the order of twenty-five hundred feet per minute with cutoff of approximately three percent without exceedng the endurance limit of the valve material at elevated temperatures, for example, of the order of 950° F. The structure of the present invention employs a valve element of relatively low mass to reduce inertia effects, and the lifter element or member and valve element are arranged to have matching in conforming interfitting configurations so that when the valve element returns to its seat, it will be in proper position for sealing purposes and so that the deceleration forces will be substantially uniformly distributed. The valve structure employs a relatively strong spring acting on the valve element to force the valve element to remain centered and aligned on top of the associated lifter element during the operation of the valve. Thus, the maximum acceleration of the associated piston occurs at top dead center and there would be a natural tendency for the valve element to float away from its lifter during closing action of the valve. This would cause a tendency for the valve element to engage its seat at an improper angle and with a much higher velocity than if it were constrained to follow its associated lifter element, due to the pressure differential across the valve element. The matching interfitting configuration employed between the valve element and its lifter is preferably conical in the structure of the present invention for minimizing the above-described tendency for improper valve action. The cone-shaped valve element is also the most efficient structural design which allows for a higher valve element, with minimum inertia.

The structure of the present invention further aims to decrease impact stress by employing a lifter element and valve seat which are somewhat resilient and which are allowed to have a small deflection. This small deflection greatly reduces impact stresses since the valve element itself can be accelerated and decelerated with some yielding action instead of with unyielding impact.

Figure 2:
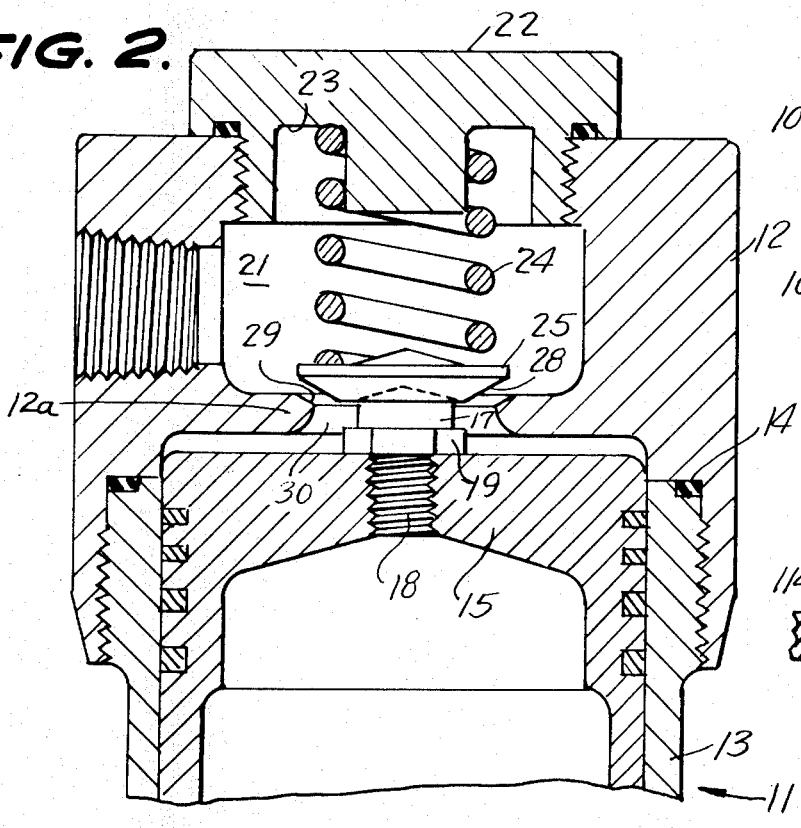
FIG. 2 is a vertical cross-sectional view similar to FIG. 1 but showing the valve element in open position at the top end of the stroke of the associated piston.
Figure 11:
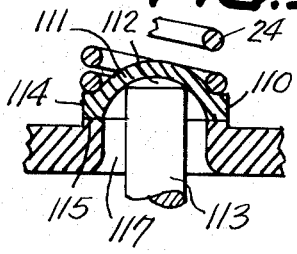
FIG. 11 is a fragmentary vertical cross-sectional view showing an additional form of valve element according to the present invention.

Referring to the drawings, and more particularly to FIGS. 1 and 2, 11 generally designates a cylinder of a high speed steam engine of the type contemplated in the present invention, the cylinder being provided with the top cylinder head portion 12 which provides the end wall 12a of the cylinder and which is threadedly secured on the lower cylinder body portion 13, employing an annular sealing gasket 14 between the head portion 12 and the body portion 12 and the body portion 13. A piston 15 reciprocates in the cylinder and a valve lifter member or element 17 is centrally mounted in or fixed to the top portion or face of the piston 15, the lifter member 17 having a threaded shank 18 which is threadedly engaged centrally in said top piston portion. The lifter member has a hexagonal flange 19 which is engagable with the top face of the piston and said lifter member is further provided with a surface of revolution in the form of an upwardly convergent conical top portion or abutment surface 20.

The head portion 12 gas a steam admission chamber 21 and is further provided with a threshold cover cap 22 axially aligned with cylinder 13 and formed with a downwardly facing annular recess 23 which provides a sear for one end of a relatively strong coiled compression spring 24, the other end of the coiled spring bearing on a valve disc member or element 25 in the chamber which has a surface of revolution in the form of a conical bottom surface or recess 26 matching and conformingly engaging with the conical top portion 20 of lifter member 17. The disc-shaped valve element 25 is provided with the flat marginal peripheral portion 27 defining a seat for the bottom end portion of the biasing spring 24. The valve disc 25 is further provided with a downwardly convergent annular frusto-conical bottom face or sealing surface 28 which is engageable with the correspondingly shaped end wall surface or valve seat 29 provided in chamber 21 surrounding the circular valve passage or part 30 which is located in end wall 12*a* immediately above the center portion of piston 15 to provide communication between the chamber and the cylinder as is clearly shown in FIG. 1. Abutment surface 20 of the lifter member and cooperable surface 26 of the valve element are concentric with sealing surface 28 of the valve element and valve seat 29.

FIG. 1 shows the valve element 25 biased into seated position by spring 24 for closing the valve port for example, before lifter 17 has risen to its valve-opening position. FIG. 2 shows piston 15 substantially in its uppermost position with the lifter element 17 engaged in the recess 26 and causing the valve element 25 to be lifted against the force of spring 24 to its open position wheren fluid can pass through the valve passage 30. As the piston descends, the valve element 25 moves downwardly to the seating position of FIG. 1 causing cutoff.

It will be seen that the generally conical-shaped valve member 25 has relatively small mass so the inertia effects are minimized, and that the spring 24 holds the valve element 25 in proper position for effective sealing as it returns toward engagement with the seat 29, and is held iun the proper position so that deceleration forces will be uniformly distributed. The spring 24, acting concentrically with surfaces 26 and 28 of the valve element forces the valve element 25 to remain on top of the lifter element 17 during the operation of the valve and maintain the generally conical member 25 in properly centered position during its closing. In other words, the spring has sufficient strength to maintain surface 26 of the valve element 25 in engagement with abutment surface 20 of lifter member 17 in both the unseating and seating of the valve element to ensure that the sealing surface 28 of the valve element is both parallel to and centered in relationship to the valve seat 29 in the seating of the valve element. Since the impact forces generated by the seating of the valve element 25 are distributed substantially uniformly over the sealing surface 28, the valve element will sustain minimum damage and can be designed to operate over long periods of time.

Figure 4:
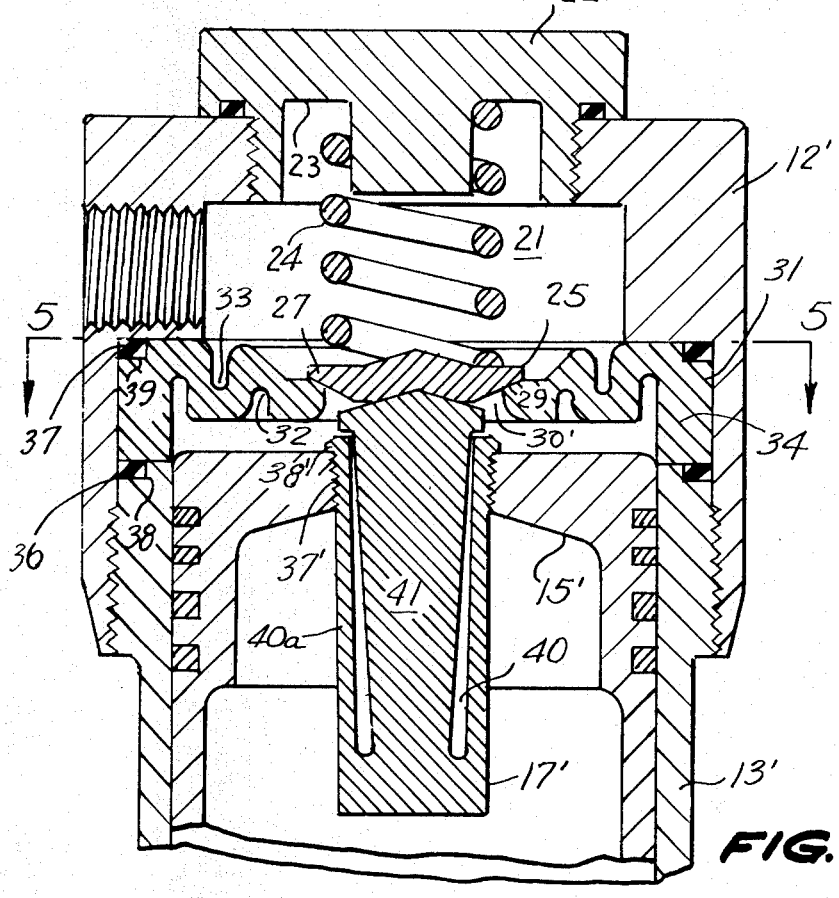
FIG. 4 is a vertical cross-sectional view similar to FIG. 1, but showing a modified form of poppet valve structure according to the present invention.
Figure 5:
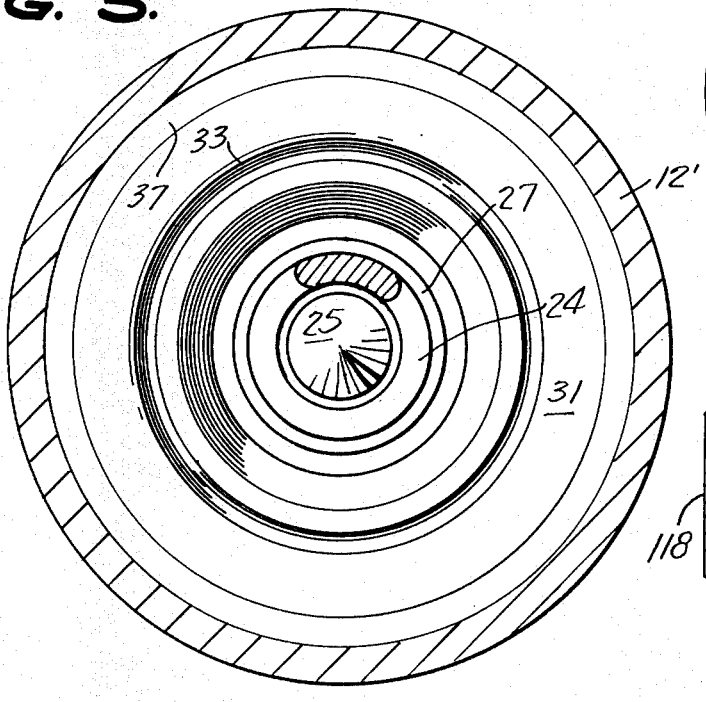
FIG. 5 is a horizontal cross-sectional view taken substantially on line 5—5 of FIG. 4.

The modification shown in FIGS. 4. 5 and 6 respresents a further means for decreasing the impact stress on the valve element and associated parts of the high speed valve assembly. In the modified structure of FIGS. 4 through 6, a head member 12' is threadably engaged on the cylinder body 13' and a resilient end wall or valve seat member 21 is interposed between the head member 12' and the top rim of the cylinder body 13'. To provide resiliency in the region of valve seat 29, the valve seat member 31 is generally annular in shape and is annularly corrugated by the provision therein of concentric recess or channels 32 and 33 respectively facing downwardly and upwardly, as shown in FIG. 4, the recesses being concentric with the central fluid passage 30' defined by the annular valve seat member 31. The member 31 is provided with the relatively rigid cylindrical outer skirt portion 34 which is equal in diameter and shape with the top rim portion of the cylinder body 13' and which is clamped thereto by the head member 12'. Annular sealing gaskets 36 and 37 are provided in respective annular recesses 38 and 39 formed in the rim portion of member 13' and of member 31 to seal the member 31 relative to the parts adjacent thereto, namely, relative to the rim of cylinder body 13' and the adjacent portion of head member 12'.

It will be noted that while the outer portion 34 of the valve seat member 31 is rigidly clamped, the annularly corrugated inner portion thereof is free to flex somewhat to provide a valve cushioning action, as will be presently described.

Figure 6:
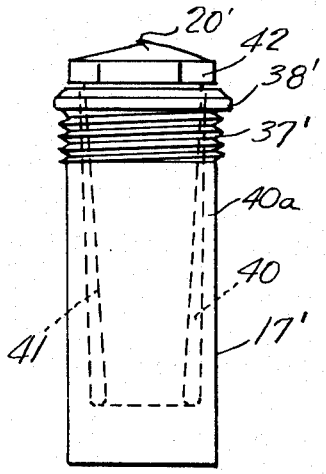
FIG. 6 is a side elevational view of the valve lifter element employed in the embodiment of FIG. 4.

Head member 12' is provided with a central cap portion 22, formed with a downwardly facing annular spring seat 23 which receives the top end of the valve biasing spring 24. The bottom end of the biasing spring 24 bears on a valve element 25 similar to that employed in the embodiment of FIGS. 1 and 2, biased downwardly toward engagement with the downwardly convergent frustoconical seat portion 29 of member 31. The bottom conical surface or recess of the valve member 25 is engagable by the similarly shaped top conical abutment surface 20' of a valve lifter member or element 17' threadedly, fixedly secured centrally in the top wall or face of the piston 15'. As shown in FIG. 6, the member 17' is an elongated body which is generally cylindrical in shape and provided with male threads 37' on its upper portion which are threadedly engaged in correspondingly shaped female threads provided in a central opening in the top wall or face of piston 15' which receives the lifter member 17', the member 17' having a stop flange 38' located above the threads 37'. The member 17' is annularly recessed as shown at 40 to define an outer sleeve portion **40*a* having its end fixed to the piston and a central downwardly tapering central column member 41 of substantial height formed at its top end with the hexagonal head portion 42 having the upwardly tapering conical lifter face or abutment surface 20' which projects from the face of the piston. As shown in FIG. 4, the column element 41 is integral with the main body of member 17' and is of substantial height and has substantial elasticity. Also, the relatively thin outer sleeve portion of member 17' is resiliently yieldable in tension. Thus, the lifter member can resiliently deform responsive to downward force exerted thereon and acts as a cushioning element when downward impact force is applied thereto, whereby it reduces the magnitude of impact stresses developing both on the lifter portion of the assembly and the valve element 25 contacted by the lifter element as it rises to open the valve. When the valve element descends, to engage seat 29, the annularly resilient seat member 31 cushions the descent of the valve element 25 thereagainst and likewise acts to reduce impact stresses generated by the seating of the valve element on the seat 29. The valve seat member 31 thus acts as a strong spring, and may have a maximum deflection at its central portion of the order of 0.0015 inch. This small deflection serves to greatly reduce the impact stresses, since the allowable movement of the valve element 25** under impact develops a much smaller net maximum stress than would be generated in the case of solid unyielding impact.

Similarly, the column element 41 is resiliently yieldable to some extent in compression and the cylindrical outer portion of member 17' is yieldable in tension in the manner above-described. The conical engaging or abutment surface portion 20' has a resilient connection to the top wall of the piston 15' and therefore the lifter element is slightly yieldable to provide a cushioning action which again serves to reduce the maximum stresses generated as a result of impact with the valve element 25.

As in the previously described embodiment of the invention shown in FIGs. 1 and 2, the conical lifter or abutment portion 20' cooperates with the conformably shaped conical botton surface or recess in the conical valve element 25 and with the centering spring 24 to properly position the valve element 25 so that stresses generated by the contact of its sealing surface with the valve seat 29 are distributed in a substantially uniform manner around the conical valve element, and so that satisfactory and positive sealing action is obtained.

It will be noted from FIGS. 4 and 6 that the hexagonal top flange portion 42 of the column portion 41 of lifter member 17' is normally spaced a short distance above the stop flange 38' of member 17', said distance being sufficient to allow for the above-described resilient deflection of member 17' generated by impact of abutment surface 20' with the conical valve member 25 during operation of the high speed engine. The resiliency of the lifter element 17' combined with the resiliency of the valve seat member 31 provides substantial reduction in the stress generated in the conical valve member 25 as it is engaged by conical element 20' for lifter action and as it descends to engage seat 29 for valve cutoff action.

Figure 9:
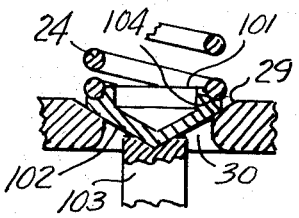
FIG. 9 is a fragmentary vertical cross-sectional view showing another form of valve element according to the present invention.

FIG. 9 shows a modification wherein the valve element, shown at 101 has a downwardly convergent conical bottom surface or face 102 having a central portion receivable in a matching conical recess or abutment surface in the lifter element 103 and an outer annular portion engageable with conical valve seat 29. The valve element is provided with an annular seat 104 which receives the bottom coil of the biasing spring 24.

Figure 10:
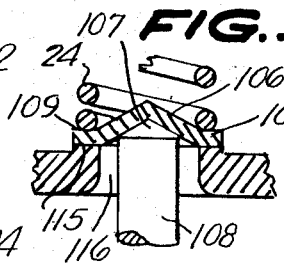
FIG. 10 is a fragmentary vertical cross-sectional view showing still another form of valve element according to the present invention.

FIG. 10 shows another modification wherein the valve element shown at 105 has an upwardly convergent conical central body portion 106 defining a conical bottom recess or abutment surface which receives the matching or conforming conical top end surface 107 of the valve lifter element shown at 108. The valve element 105 has a flat annular peripheral seat 109 on which the bottom coil of the biasing spring 24 bears.

FIG. 11 shows another modification wherein the conforming engageable surfaces of revolution which provide the abutment surface of the lifter member and the cooperable surface of the valve element comprise spherical surfaces. Specifically, the valve element, shown at 110, has a generally hemispherical, downwardly concave main body portion 111 which receives the spherically curved matching top end portion 112 of the valve lifter element 113. A peripheral flange 114 formed integrally with said main body portion provides a seat for the bottom coil of the biasing spring 24.

Figure 13:
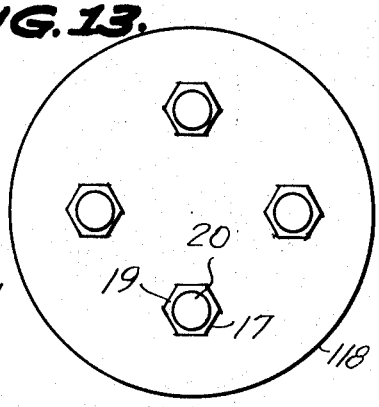
FIG. 13 is a top plan view of a piston provided with multiple lifter elements for operating multiple valve elements for distributed poppet valve action in accordance with the present invention.
Figure 14:
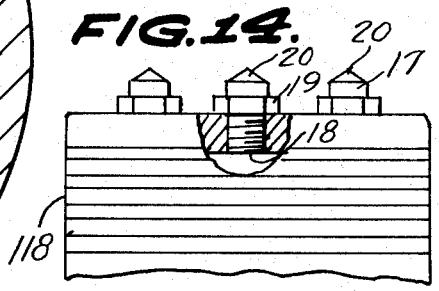
FIG. 14 is a fragmentary side elevational view, partly in cross-section, of the upper portion of the piston shown in FIG. 13.

In the forms shown in FIGS. 10 and 11, the valve elements have flat or planar annular bottom sealing surfaces 115 cooperating with mating flat annular seats provided around the central fluid passage shown respectively at 116 and 117. By using valves similar to those shown in FIGs. 10 and 11, it is possible to use two or more valves (for example, four valves, as illustrated in FIGS. 13 and 14) in each cylinder in order to reduce the diameter (and hence, the mass and inertia) and required lift of the valve elements in order to obtain the same steam admission area as one large single valve. The flat seats allow the piston, shown at 118, to rotate slightly and still allow the valve elements to seat. with such flat seats it is not so essential that the valve elements always return to exactly the same positions on their seats. By employing several small valve elements with low lift and low inertia, it is possible to avoid the use of resilient seats and lifters.

The typical distributed lifters 17 with conical abutment faces 20, fixed to the face of the piston as shown in FIGS. 13 and 14, may be employed with a respective plurality of conical valve elements 105 such as shown in FIG. 10, provided with flat bottom sealing surfaces 115, as above-described, for cyclically unseating the valve elements against the force of associated springs.

Figure 12:
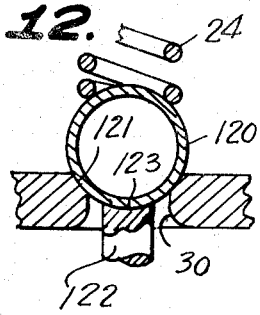
FIG. 12 is a fragmentary vertical cross-sectional view showing a still further form of valve element according to the present invention.

FIG. 12 shows still another modification wherin the valve element, shown at 120 is in the form of a hollow ball or sphere and is sealingly receivable in a spherically curved annular seat 121 provided around the fluid flow passage 30. The lifter element 122 is formed with a matching spherically curved recess 123, and the bottom coil of the biasing spring 24 bears on the top of the hollow ball member 120 opposite the lifter element 122.

As in the case of the previously described valve elements, the hollow ball valve element 120 has a high degree of structural efficiency which enables it to be relatively light and thus to have relatively low inertia. The valve element may be elliptical in vertical cross-section rather than circular, within the spirit of the present invention.

Since the above-described steam admission valves have constant cutoff, it is desirable to provide means for varying the clearance volume of the cylinders associated with such valves. By varying the clearance volume, it is possible to increase or decrease the amount of steam admitted to the top of the cylinder, depending upon the horsepower or efficiency required of the associated motor. A large clearance volume will increase the power developed by the engine, while a small clearance volume will increase the efficiency thereof.

Figure 7:
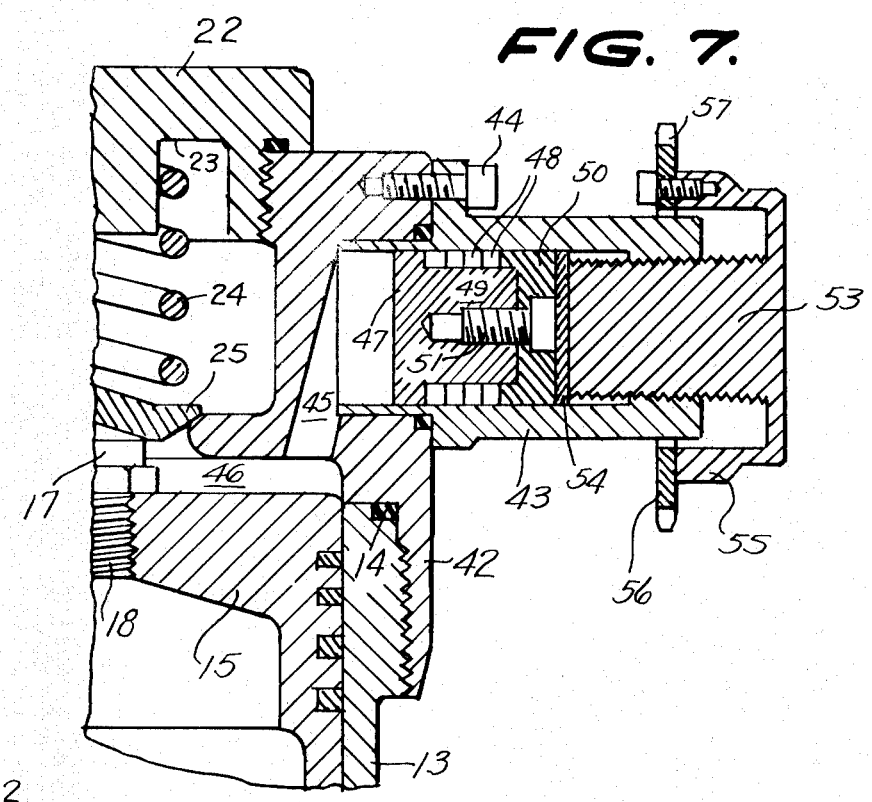
FIG. 7 is a fragmentary vertical cross-sectional view taken through the upper portion of a cylinder of an improved high speed steam engine according to the present invention showing a means for manually varying the clearance volume in the cylinder.
Figure 8:
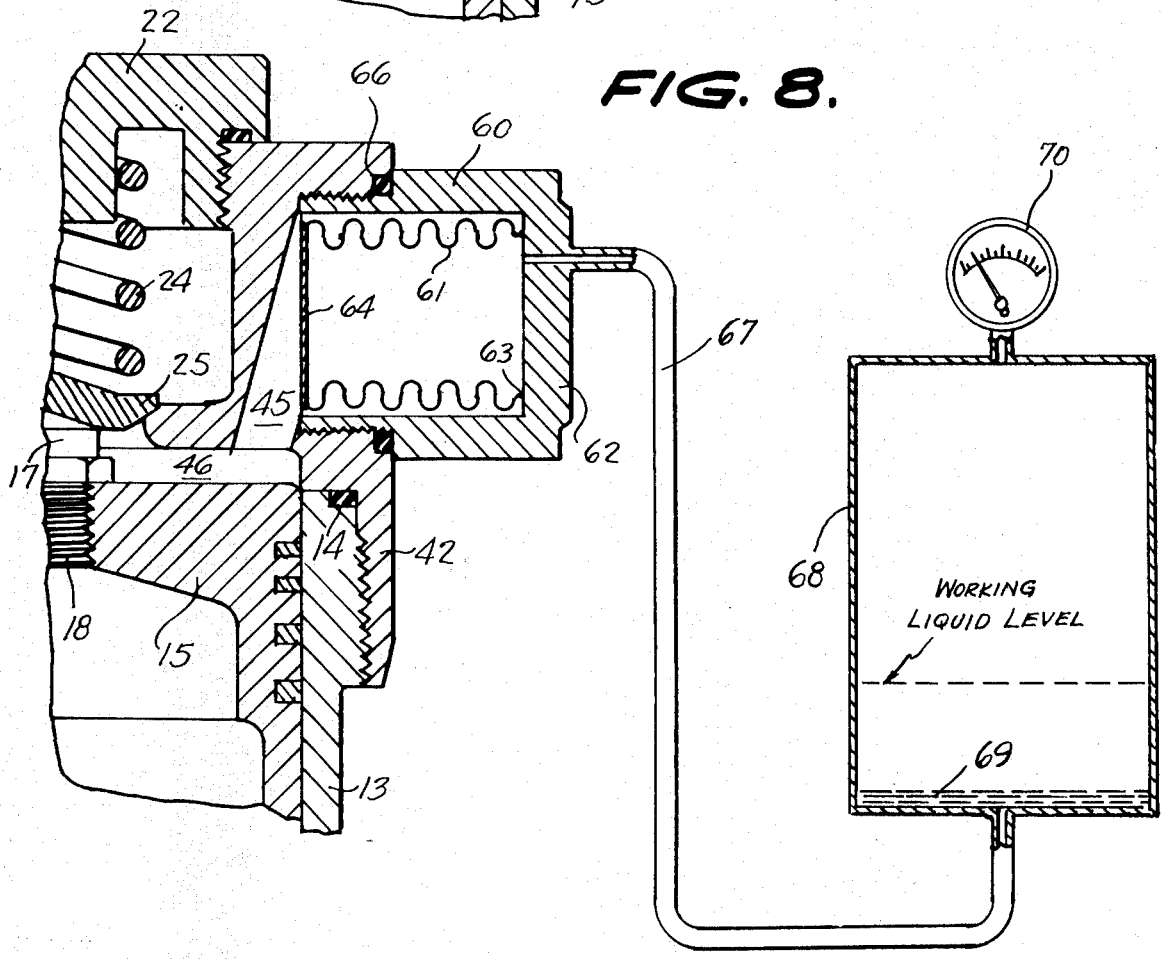
FIG. 8 is a vertical cross-sectional view similar to FIG. 7 and diagrammatically illustrating a means for automatically varying the clearance volume in the engine cylinder in accordance with the present invention.

FIGS. 7 and 8 illustrate two possible structures for changing the clearance volume of a high speed steam engine such as is contemplated by the present invention, while the engine is running. FIG. 7 illustrates a structure providing manual control for changing the clearance volume at any time independently of the pressure or RPM of the motor, while FIG. 8 illustrates a structure for automatically controlling the clearance volume and changing same at high power output (using high steam pressure or high mean effective steam pressure).

Referring to the manually controlled clearance volume-changing means of FIG. 7, the cylinder head member, shown at 42, is provided with a clearance-adjusting chamber 43 which is secured to the upper portion of the head member 42, as by suitable bolts 44 and which communicates with a passage 45 leading to the top clearance space 46 of the associated cylinder containing the piston 15 which carries the valve lifter member 17, as shown in FIG. 7. In the typical embodiment illustrated in FIG. 7, the chamber 43 is of substantially cylindrical form and projects perpendicularly to the axis of the associated cylinder 13. The cylindrical chamber 43 contains a piston 47 which is slidably and sealingly engaged in the cylindrical chamber 43, being provided with the high temperature packing rings 48 disposed on the reduced rightward portion 49 of the piston 47, as viewed in FIG. 7, and held in place by a cup-like retaining ring 50 secured to piston member 47 by an axial fastening screw 51, whereby the retaining member 50 holds the deformable packing ring elements 48 in proper position for sealing contact with the bore of the cylindrical chamber 43, as is clearly seen from FIG. 7. An adjusting screw member 53 is threadedly engaged with the outer end portion of cylinder 43 and is arranged to transmit thrust to the piston assembly comprising the elements 47 and 50 through a carbon thrust washer 54 which allows the screw member 53 to rotate relative to the piston 47 without fretting or otherwise suffering damage at the high temperatures and pressures prevailing under operating conditions. The screw member 53 is provided with a skirt portion 55 to which is secured a sprocket ring 56 having sprocket teeth 57 adapted to be engaged by a suitable sprocket chain connected to a sprocket shaft employed for adjusting the clearance volume. Obviously, various other devices for manually rotating screw member 53 may be employed within the spirit of the present invention.

By turning the screw member 53 in one direction or the other, the pistion member 47 is moved inwardly or outwardly, which decreases or increases the clearance volume in the space defined between piston member 47 and the main piston member 15. Thus, the space leftwardly adjacent the piston 47 in FIG. 7 can be adjusted by rotating the screw member 53.

With the type of clearance volume control illustrated in FIG. 7, the overall clearance volume of the associated power-generating piston 15 may be changed by as much as 200 to 300 percent while the engine is running. This change in clearance volume will change the power produced by the engine at constant steam admission pressures by as much as 200 percent.

Referring now to FIG. 8, the automatic clearance volume control structure, which may be employed instead of the manual clearance volume control structure of FIG. 7, comprises a bellows housing 60 secured to the upper end portion of the head member 42 and projecting perpendiculary thereto, the housing 60 containing a metal bellows 61 sealingly attached to the outer wall 62 of housing 60 at 63. The free end wall of the bellows 61 comprises a piston element 64 which cooperates with the inner bore of the generally cylindrical housing 60 to vary the space at the left side thereof, as viewed in FIG. 8, in accordance with the expansion and contraction of the bellows 61. The space at the left side of the piston element 64 communicates with the passage 45 leading to the top clearance space 46 in the cylinder of the associated power-generating piston 15.

The bellows cylinder 60 may be secured to the head member 42 in any suitable manner, for example, by being threadedly secured thereto in a manner shown in FIG. 8, with an annular sealing gasket 66 provided for sealing housing member 60 with respect to head member 42.

The bellows 61 is connected through a relatively small diameter tube 67, connected to end wall 62, to an accumulator 68. A eutectic-metal alloy 69 is provided in the accumulator 68, the tube 67 and the bellows 61, the alloy 69 melting at a temperature of about 160° F. and boiling at approximately 1300° F. The accumulator chamber 68 is submerged in the steam exhaust associated with the engine, in any suitable manner, so that the metal alloy 69 will be kept in a liquid state during operation of the engine. The accumulator 68 is charged to a pressure which corresponds to the mean effective pressure in the cylinder 13, which is approximately one-hundred fifty pounds per square inch when the steam admission pressure is fifteen hundred pounds per square inch. As the admission pressure in increased beyond fifteen hundred pounds per square inch, the mean effective pressure will also increase. When the mean effective pressure in the cylinder 13 (and in clearance space 46) is greater than the pressure in the accumulator 68, the bellows will be compressed, and in doing so will increase the clearance volume of the cylinder 13. In the typical device herein being described, at a steam admission pressure of two thousand pounds per square inch, the mean effective pressure will be great enough to completely compress the bellows 61 and provide the maximum increase in clearance volume. The relatively small diameter tube 67 controls the rate at which the eutectic alloy can flow in and out of the bellows. The rapid changes of pressure in the cylinder 13 (in space 46) which occur during expansion of the steam do not allow sufficient time for the bellows to change its shape and move piston element 64. A change in mean effective pressure extending over a period of time is required to displace the liquid 69 from the bellows and change the clearance volume.

The bellows 61 are formed of several very thin plies of a high temperature-resisting metal alloy, providing a substantial amount of deflection capability for a given length of bellows. The bellows will never be called upon to sustain any more internal pressure than that which is developed in the accumulator 68. A pressure gauge 70 is connected to the accumulator 68 providing an indication of the mean effective pressure of the associated engine cylinder, when said pressure is above the accumulator charge pressure.

With the arrangement illustrated in FIG. 8, the clearance volume is controlled automatically to give the power required. Assuming that the engine is employed to drive a vehicle, in cruise conditions (less than fifteen hundred pounds per square inch steam admission pressure), the engine operates with an efficient low clearance volume, but as the steam admission pressure increases above fifteen hundred pounds per square inch due to an increased power requirement, the clearance volume also increases. By increasing the clearance volume 200 to 300 percent, the power output is increased by approximately 200 percent, even though the steam admission pressure is only increased from fifteen hundred pounds per square inch to two thousand pounds per square inch. Thus, the automatic clearance-adjusting control arrangement of FIG. 8 permits an engine to be designed so as to have small size, with an efficient low clearance volume, but with very large power overload capabilities.

While certain specific embodiments of structural improvements for high speed steam engines have been disclosed in the foregoing description, it will be understood that various modifications within the spirit of the invention may occur to those skilled in the art. Therefore, it is intended that no limitations be placed on the invention except as defined by the scope of the appended claims.

What is claimed is:

1. In a steam engine, a cylinder containing a reciprocable piston, a steam admission chamber communicating with the cylinder through a circular valve port in an end wall of the cylinder, an annular surface portion of the end wall surrounding the port forming a valve seat in said chamber, a valve element in the chamber having an annular sealing surface to engage the valve seat, spring means biasing the valve element into seated position to close the valve port, and a substantially rigid valve lifter member fixed to an uppermost portion of the piston, the piston, the valve element, spring means and valve lifter member being disposed on a common longitudinal axis, the lifter member having an abutment surface for engaging a cooperable surface on the valve element to unseat the valve element against the force of said spring means to open the valve port, the spring means having sufficient strength to maintain the abutment surface and the cooperable surface in engagement while the valve element is unseated, said abutment surface and said cooperable surface comprising non-planar conforming surfaces of revolution coaxially related to said valve seat, whereby the sealing surface of the valve element is maintained both parallel to and centered in relationship to the valve seat in the seating of the valve element.

2. Apparatus as set forth in claim 1, wherein said abutment surface and said cooperable surface comprise spherical surfaces.

3. Apparatus as set forth in claim 2, wherein the valve element comprises a hollow sphere.

4. Apparatus as set forth in claim 1, wherein said abutment surface and said cooperable surface comprise conical surfaces.

5. Apparatus as set forth in claim 4, wherein said cooperable surface and said sealing surface comprise portions of a conical surface of the valve element.

6. Apparatus as set forth in claim 1 wherein the valve element is generally disc-shaped.

7. Apparatus as set forth in claim 1, wherein said valve seat and said sealing surface comprise planar surfaces.

8. Apparatus as set forth in claim 7, wherein the face of the piston has a plurality of said lifter members fixed thereto for unseating a respective plurality of valve elements against the force of said spring means.

9. Apparatus as set forth in claim 1, wherein the spring means comprises a coiled compression spring acting substantially coaxially with said cooperable surface and said sealing surface of the valve element.

10. Apparatus as set forth in claim 1, wherein the end wall of the cylinder has an annular recess substantially concentric with the valve seat for providing resiliency in the end wall in the region of the valve seat.

11. Apparatus as set forth in claim 1, wherein the substantially rigid lifter member is mounted to deflect in compression, the face of the element providing said abutment surface.

12. Apparatus as set forth in claim 1, wherein the lifter member comprises a generally cylindrical elongated body having an annular recess formed therein to provide an outer sleeve portion and a central column portion, the base of the column portion being connected to said sleeve portion, the body being received by an opening in the face of the piston with an end of the sleeve portion being fixed to the piston, and wherein the central column portion projects from the face of the piston and provides said abutment surface.

13. Apparatus as set forth in claim 1, wherein the valve element is generally disc-shaped.

14. The steam engine of claim 1, and adjustable chamber means communicating with the clearance space adjacent the face of the piston for varying the clearance volume.

15. The steam engine or claim 14, and wherein said adjustable chamber means comprises an auxiliary cylinder mounted on the first-named cylinder and communicating with said clearance space, a piston element in said auxiliary cylinder, and means for adjusting the positions of said piston element in said auxiliary cylinder.

16. The steam engine of claim 15, and wherein said adjusting means comprises an abutment member threadedly engaged with said auxiliary cylinder, extending substantially in the same longitudinal direction as said piston element, and arranged to exert thrust on said piston element.

17. The steam engine of claim 15, and wherein said adjusting means compises a flexible bellows connecting said piston element to the outer end of said auxiliary cylinder, and a source of imcompressible fluid operatively connected to said bellows.

18. The steam engine of claim 17, and wherein said source of pressure fluid comprises an accumulator containing eutectic alloy material.

19. The steam engine of claim 18, and wherein said eutectic alloy material comprises normally solid metal alloy capable of being liquified at elevated temperatures.

20. The steam engine of claim 19, and wherein the connection between the accumulator and the bellows includes relatively small-diameter passage-defining means for retarding the response of said bellows to changes in pressure in said first-named cylinder.

* * * * *

UNITED STATES PATENT AND TRADEMARK OFFICE

CERTIFICATE OF CORRECTION

PATENT NO. : 4,050,357

DATED : September 27, 1977

INVENTOR(S) : J. Warne Carter, Sr., and J. Warne Carter, Jr.

It is certified that error appears in the above-identified patent and that said Letters Patent are hereby corrected as shown below:

Column 1, line 9, "proper" should read --poppet--.

Column 1, line 17, "popper" should read --poppet--.

Column 1, line 18, "stream" should read --steam--.

Column 1, line 18, "deree" should read --degree--.

Column 1, line 23, "objects" should read --object--.

Column 1, line 30, cancel "to"

Column 2, line 16, "set" should read --seat--.

Column 3, line 50, "in" should read --or--.

Column 4, line 4, "higher" should read --lighter--.

Column 4, line 33, "threshold" should read --threaded--.

Column 4, line 36, "sear" should read --seat--.

Column 4, line 64, "wheren" should read --wherein--.

Column 5, line 4, "iun" should read --in--.

Column 5, line 33, "recess" should read --recesses--.

Column 9, line 9, "perpendiculary" should read --perpendicularly--.

UNITED STATES PATENT AND TRADEMARK OFFICE

CERTIFICATE OF CORRECTION

PATENT NO. : 4,050,357

DATED : September 27, 1977

INVENTOR(S) : J. Warne Carter, Sr., and J. Warne Carter, Jr.

It is certified that error appears in the above-identified patent and that said Letters Patent are hereby corrected as shown below:

Column 10, line 67, "claim 1" should read --claim 4--.

Column 12, line 3, "or" should read --of--.

Signed and Sealed this

*Twenty-eighth* Day of *March 1978*

[SEAL]

*Attest:*

RUTH C. MASON
*Attesting Officer*

LUTRELLE F. PARKER
*Acting Commissioner of Patents and Trademarks*